US007431663B2

(12) United States Patent
Pamias

(10) Patent No.: US 7,431,663 B2
(45) **Date of Patent: *Oct. 7, 2008**

(54) ADJUSTABLE GOLF PUTTER

(76) Inventor: Francisco Pamias, 472 Marlboro Rd., Old Bridge, NJ (US) 08857

( * ) Notice: Subject to any disclaimer, the term of this patent is extended or adjusted under 35 U.S.C. 154(b) by 0 days.

This patent is subject to a terminal disclaimer.

(21) Appl. No.: 11/558,744

(22) Filed: Nov. 10, 2006

(65) Prior Publication Data

US 2008/0113824 A1 May 15, 2008

(51) Int. Cl.
*A63B 53/02* (2006.01)
*A63B 53/04* (2006.01)
*A63B 53/16* (2006.01)

(52) U.S. Cl. ..... 473/288; 473/309; 473/307; 473/313; 473/341

(58) Field of Classification Search ..... 473/340–341, 473/309, 313, 288, 307
See application file for complete search history.

(56) References Cited

U.S. PATENT DOCUMENTS

| | | | | |
|---|---|---|---|---|
| 4,227,694 | A | 10/1980 | Drake | |
| 4,795,153 | A | 1/1989 | Thomas | |
| 5,127,650 | A | 7/1992 | Schneller | |
| 5,328,185 | A | 7/1994 | Finnigan et al. | |
| 6,190,266 | B1 | 2/2001 | Pamias | |
| 6,203,446 | B1 * | 3/2001 | Collins | 473/313 |
| 7,201,668 | B1 * | 4/2007 | Pamias | 473/288 |
| 2004/0102255 | A1 * | 5/2004 | Benson | 473/276 |

* cited by examiner

*Primary Examiner*—Stephen L. Blau
(74) *Attorney, Agent, or Firm*—Albert Bordas, P.A.

(57) ABSTRACT

An adjustable golf putter comprising a top shaft assembly, a bottom shaft assembly, a hosel assembly, a putter head, and a removable handle assembly. When the handle assembly is installed, the ergonometric golf putter has a zigzag shape. This configuration better enables the golfer to sight the ball and effect a putt. When the handle assembly is removed, the ergonometric golf putter has a straight shape. This configuration enables the golfer to utilize the golf putter as a traditional straight golf putter. In addition, the hosel assembly defines a predetermined lie angle to accommodate the golfer's preference. The same putter is usually adaptable for a right or left handed user.

11 Claims, 5 Drawing Sheets

ADJUSTABLE GOLF PUTTER

BACKGROUND OF THE INVENTION

1. Field of the Invention

The present invention relates to a golf putter, and more particularly, to an adjustable golf putter that includes a removable handle assembly.

2. Description of the Related Art

In the game of golf, it is often necessary to putt on the green. The putter club is very important, and selecting a right club may be challenging at times. The golfer often searches for a putter that is comfortable to grip and facilitates motion when striking a golf ball. However, different body-builds and putting stances cause many golfers to compromise their best "fit" because club manufacturers design clubs for the average person only. One of the major variables in a putter club "fit" is the handle and gripping points of the shaft in correspondence with the desired inclination angle of the shaft to the putter head.

The golf putter performs a function different from the other clubs in a set. The other clubs are designed for moving the ball across assorted terrains, distances and hazards, and are generally designed for the free flowing swing of the club head selected for the particular hole. The green represents a different golfing pattern, a substantially uniform, usually flat pattern, with short, clipped grass. The putter, with its particular head, does not have to move the golf ball great distances, nor is the putter used for heavy swinging. The putter head is usually without an angle, because the ball does not usually have to be lifted over uneven terrain, such as along the fairway or the rough. There are many different types of putters with special shafts and putting heads and second handgrips for the control of a careful swing.

Several designs for golf putter assemblies have been developed in the past. None of them, however, disclose a removable and replaceable handle assembly that connects a top shaft assembly to a bottom shaft assembly, and further comprising replaceable hosel assemblies to accommodate the preference of the golfer.

Applicant believes that the closest references corresponds to Applicant's own U.S. patent application Ser. No. 11/230,225, filed on Sep. 20, 2005, for a replaceable hosel assembly for golf club. However, it differs from the present invention, because Applicant's pending application teaches a replaceable hosel assembly for a golf club that enables a golfer to adjust an inclined angle of a putter shaft to a putter head, so as to satisfy a user's preference. The replaceable hosel assembly has an upper end adapted to fit the club shaft and the lower end fitted to the putter head. A plurality of removable hosel assemblies having pre-selected angles between the ends of the component, determines the golfer's preferred angle of inclination or lie angle.

Applicant believes that another reference corresponds to Applicant's own U.S. Pat. No. 6,190,266 issued on Feb. 20, 2001 for a golf putter. However, it differs from the present invention because Applicant's patented invention teaches an ergonometric golf putter having a zigzag shaft with an intermediate handle, shaft arms and a handgrip. The configuration better enables the golfer to sight the ball and effect a putt. The same putter is usually adaptable for a right or left handed user.

Applicant believes that another reference corresponds to U.S. Pat. No. 4,795,153 issued to Thomas on Jan. 3, 1989 for a golf club. However, it differs from the present invention because Thomas teaches a golf club particularly adapted as a putter that includes a club head, a handle portion and a shaft structure interconnecting the club head and the handle portion. The shaft structure includes a lower shaft portion and an intermediate shaft portion. The lower shaft portion is preferably formed of two parallel lower shaft sections oriented in side-by-side relation perpendicular to the club head to define a lower shaft plane that contains the axis of the club head and that is perpendicular to the attack plane of the golf club. The handle portion is offset from the lower shaft axis by the intermediate shaft portion so that the handle portion or the golfer's hands do not obstruct the golfer's view line during a golf stroke. The handle axis is preferably in the lower shaft plane and is parallel to the lower shaft axis. The lower shaft sections may either be independent cylindrical elements or be constructed by collapsing a diametric portion of a hollow tube along its longitude to form a pair of parallel tubular elements interconnected by a longitudinal web.

Applicant believes that another reference corresponds to U.S. Pat. No. 5,328,185 issued to Finnigan, et al. on Jul. 12, 1994 for a golf putter. However, it differs from the present invention because Finnigan teaches a golf putter, with an extended length shaft having an upper end adapted to be held against the front of the golfer's body in an anchor position during the putting stroke. A club head is affixed to the lower end of the shaft, and has a planar ball-striking face formed thereon. A shaft grip is positioned intermediate the upper and lower ends. The shaft grip extends backwardly from the shaft means away from and transverse to the ball-striking face of the club head. The shaft grip is positioned along the length of the shaft to enable gripping thereof by the golfer's other hand. The shaft grip may be one elongated member, or a pair of vertically spaced elongated members. When the spaced elongated members are used, the shaft may be separated at the inner ends of the elongated members while the outer ends are connected together to form a U-shaped shaft grip whereby the shaft grip becomes a part of a continuous shaft having a U-shaped bend intermediate the club head and the upper end of the shaft. Basically, Finnigan's patented invention is a golf putter with an extended length shaft to be held against the front of the golfer's body. There is an upper hand grip and an intermediate, looping, substantially horizontal handgrip, extending on a plane substantially perpendicular from the back end of the putter head. The substantially horizontal handgrip requires the wrist to be twisted to face the body. The palm of the hand gripping the horizontal handle faces the body.

Applicant believes that another reference corresponds to U.S. Pat. No. 4,227,694 issued to Drake on Oct. 14, 1980 for an aim-assisting golf putter. However, it differs from the present invention because Drake teaches an aim-assisting golf putter that immediately above the connection at the center of the head of this golf putter to its shaft, the latter has a forwardly-extending elongated horizontal primary lower aiming portion perpendicular to the center of the forward face of the putter head. An upwardly-inclined intermediate secondary aiming portion of the shaft extends from the forward end of the lower aiming portion to the lower end of the handle-attached upper portion of the shaft, which is approximately aligned with the rearward face of the putter head. The lower and intermediate shaft portions lie approximately in a vertical plane perpendicular to the forward face of the putter head and passing through the center of that forward face.

Applicant believes that another reference corresponds to U.S. Pat. No. 5,127,650 issued to Schneller on Jul. 7, 1992 for a golf putter and method for putting. However, it differs from the present invention because Schneller teaches a golf putter that has an elongated shaft having upper and lower portions. A putter head fixedly mounted to the end of the lower portion of the shaft. A grip is provided having an upper portion and a lower portion, said grip being fixed to the upper portion of the shaft. The upper portion of the grip has a smooth surface adapted to be gripped by all fingers and the palm of the upper hand of the golfer, said upper portion of the grip being substantially in line with the lower portion of the grip. The lower portion of the grip has a non-slip surface, which is a sufficient distance from the upper portion of the grip so that during the putting stroke the club can be powered by the lower hand of the golfer while at the same time maintaining the upper hand in a stationary position. The upper portion of the grip further comprises a flattened surface adapted to accommodate the four fingers of the upper hand of the golfer, said surface being in a plane approximately normal to the surface of the putter head.

Other patents describing the closest subject matter provide for a number of more or less complicated features that fail to solve the problem in an efficient and economical way. None of these patents suggest the novel features of the present invention.

SUMMARY OF THE INVENTION

An adjustable golf putter comprises a top shaft assembly having first and second ends, and a bottom shaft assembly has third and fourth ends. A plurality of replaceable hosel assemblies each comprises first and second elongated engagement elements and each have a different predetermined angle between their respective first and second elongated engagement elements. Each of the different predetermined angle establish a 1 degree lie angle change between them and within a lie angle range of 60 degree to 80 degree. Furthermore, each plurality of replaceable hosels has a proximal end and a distal end and each proximal end and a distal end has a longitudinal axis. The first elongated engagement element is substantially hollow to removably receive the third end, and the second elongated engagement element is solid. The second elongated engagement comprises a protrusion located at a first predetermined distance from the distal end and adjacent to the first elongated engagement.

A putter head comprises a face and a base plate. The face is substantially perpendicularly disposed with respect to the base plate. The face is designed to strike a golf ball when putting. Angularly extending from the face, are first and second sidewalls. The putter head further comprises a V-shaped top wall that connects the face to the first and second sidewalls. The V-shaped top wall has a merging point that comprises a first aperture. The first aperture has a channel extending towards the base plate a second predetermined distance but does not reach the base plate. The first aperture removably receives the second elongated engagement element while the channel receives the protrusion. Assembly means may be used to assemble the top shaft assembly to the bottom shaft assembly, and to one of the plurality of replaceable hosel assemblies, and to the putter head to form a straight configuration.

The assembly means comprises one of the plurality of replaceable hosel assemblies directly engaging to the putter head. The assembly also means comprises the bottom shaft assembly directly engaging to one of the plurality of replaceable hosel assemblies. The assembly means also comprises the top shaft assembly directly engaging to the bottom shaft assembly.

The instant invention also comprises a removable handle assembly positioned in between the top shaft assembly and the bottom shaft assembly to form a zigzag configuration. The top shaft assembly and the bottom shaft assembly extend on a plane substantially parallel to each other. In this configuration, the removable handle assembly is aligned extending parallel over the putter head.

The first end comprises a first female fitting and the second end comprises a first male fitting having a second aperture. The top shaft assembly further comprises a first hole a third predetermined distance from the first end without reaching the second end. The fourth end comprises a second female fitting. The bottom shaft assembly further comprises a second hole a fourth predetermined distance from the third end without reaching the fourth end.

The handle assembly comprises a grip member with fifth and sixth ends. The grip member has a gripping surface positioned in between the fifth and sixth ends. The fifth end comprises a third female fitting and the sixth end comprises a second male fitting having a third aperture. The handle assembly further comprises a third hole a fifth predetermined distance from the fifth end without reaching the sixth end.

The instant invention further comprises headless screws that screw into the first, second and third holes for securing the top shaft assembly to the handle assembly and to the bottom shaft assembly to form the zigzag configuration.

The V-shaped top wall is substantially planer. The face and the first and second sidewalls are a same height. The V-shaped top wall and the base plate are substantially parallel with respect to each other.

It is therefore one of the main objects of the present invention to provide an adjustable golf putter having a removable handle assembly.

It is another object of the present invention to provide an adjustable golf putter that enables a golfer to obtain a desired gripping action and lie angle.

It is another object of the present invention to provide an adjustable golf putter that can be used interchangeably for either right or left-hand putters.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
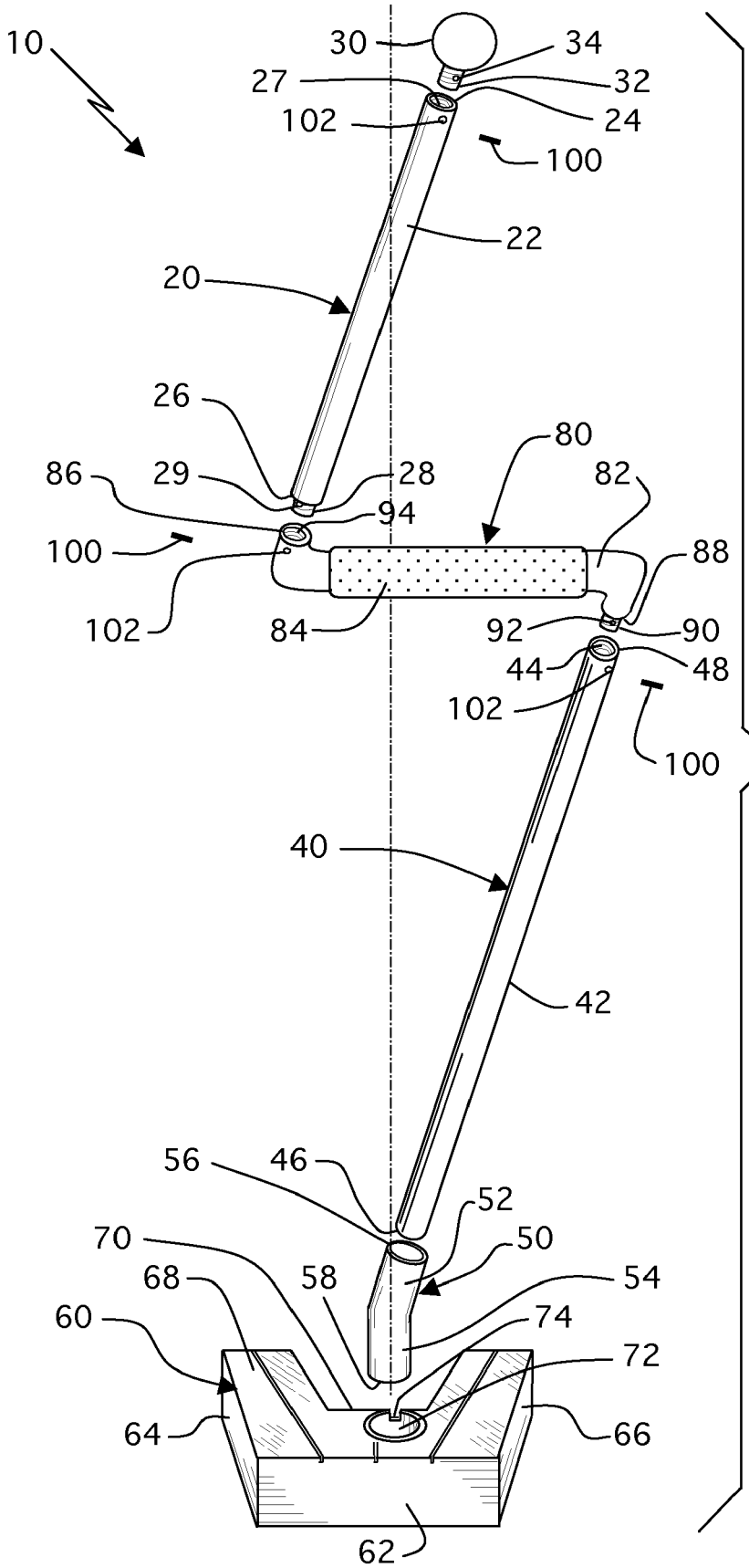
FIG. 1 represents an exploded isometric view of the instant invention.

Referring now to the drawings, the present invention is defined as an adjustable golf putter and is generally referred to with numeral 10. It can be observed that it basically includes top shaft assembly 20, bottom shaft assembly 40, hosel assembly 50, putter head 60, and handle assembly 80. It is noted that the same putter is usually adaptable for a right or left handed user.

As seen in FIG. 1, top shaft assembly 20 comprises top shaft member 22 with ends 24 and 26. At end 24, top shaft member 22 has female fitting 27, and at end 26, top shaft member 22 has male fitting 28 with aperture 29. Positioned above end 24 is handle 30. Handle 30 includes male fitting 32 with aperture 34. Male fitting 32 fits into female fitting 27.

Bottom shaft assembly 40 comprises bottom shaft member 42 with ends 44 and 46. At end 44, bottom shaft member 42 has female fitting 48. Removable and replaceable hosel assembly 50 comprises angled portion 52, straight portion 54, and ends 56 and 58. End 56 is open and of cooperative characteristics to receive end 46 of bottom shaft member 42. Angled portion 52 and straight portion 54 are disposed in a predetermined angle with respect to each other to define a lie angle. The lie angle may be different for each different hosel assembly 50, to be used according to the user's preference. It is noted that angled portion 52 is hollow to receive end 46 of bottom shaft member 42.

Putter head 60 comprises face 62. Angularly extending from face 62 are sidewalls 64 and 66. Top wall 68 has a substantially V-shape and connects face 62 and sidewalls 64 and 66 for structural stability. End 70 is located at the merging point of the substantially V-shaped top wall 68. Aperture 72 has notch 74. End 70 is tangent to aperture 72. It is noted that straight portion 54 of hosel assembly 50, serves as a male fitting to aperture 72 while notch 74 receives protrusion 55, seen in FIG. 5.

Handle assembly 80 comprises grip member 82 with ends 86 and 88. Wrapped around grip member 82 is gripping surface 84. At end 86, grip member 82 has female fitting 94, and at end 88, grip member 82 has male fitting 90 with aperture 92.

Top shaft assembly 20, bottom shaft assembly 40, and handle assembly 80 comprise holes 102 that received headless screws 100.

Figure 2:
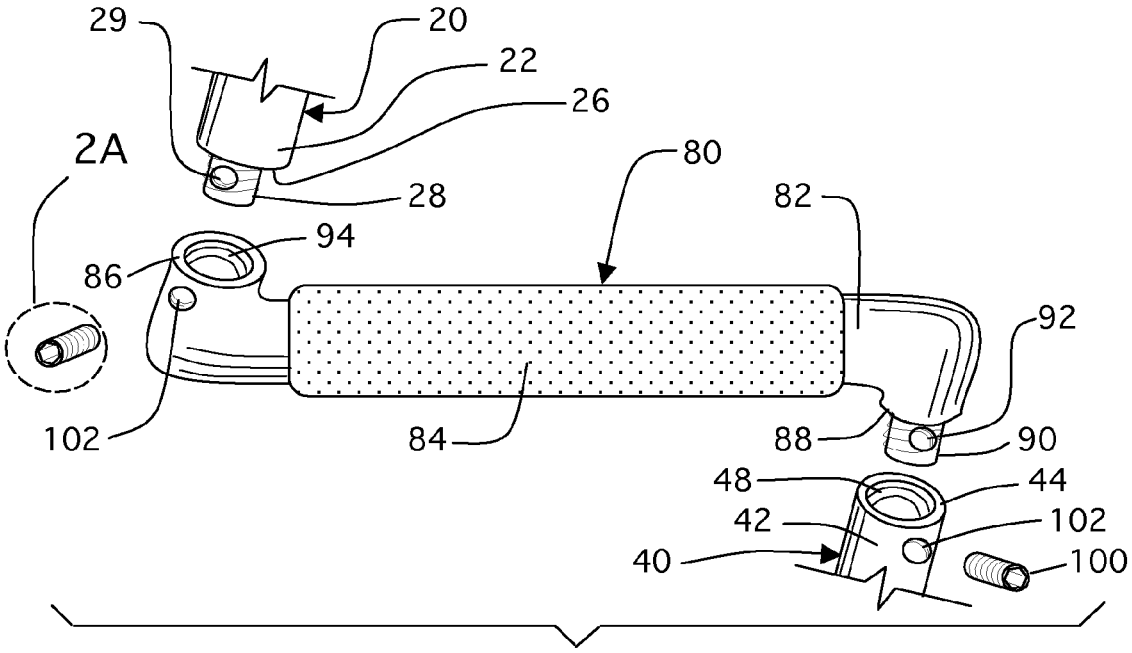
FIG. 2 is an enlarged isometric view of the handle assembly represented in FIG. 1, wherein the top shaft assembly and the bottom shaft assembly are partially shown.
Figure 3:
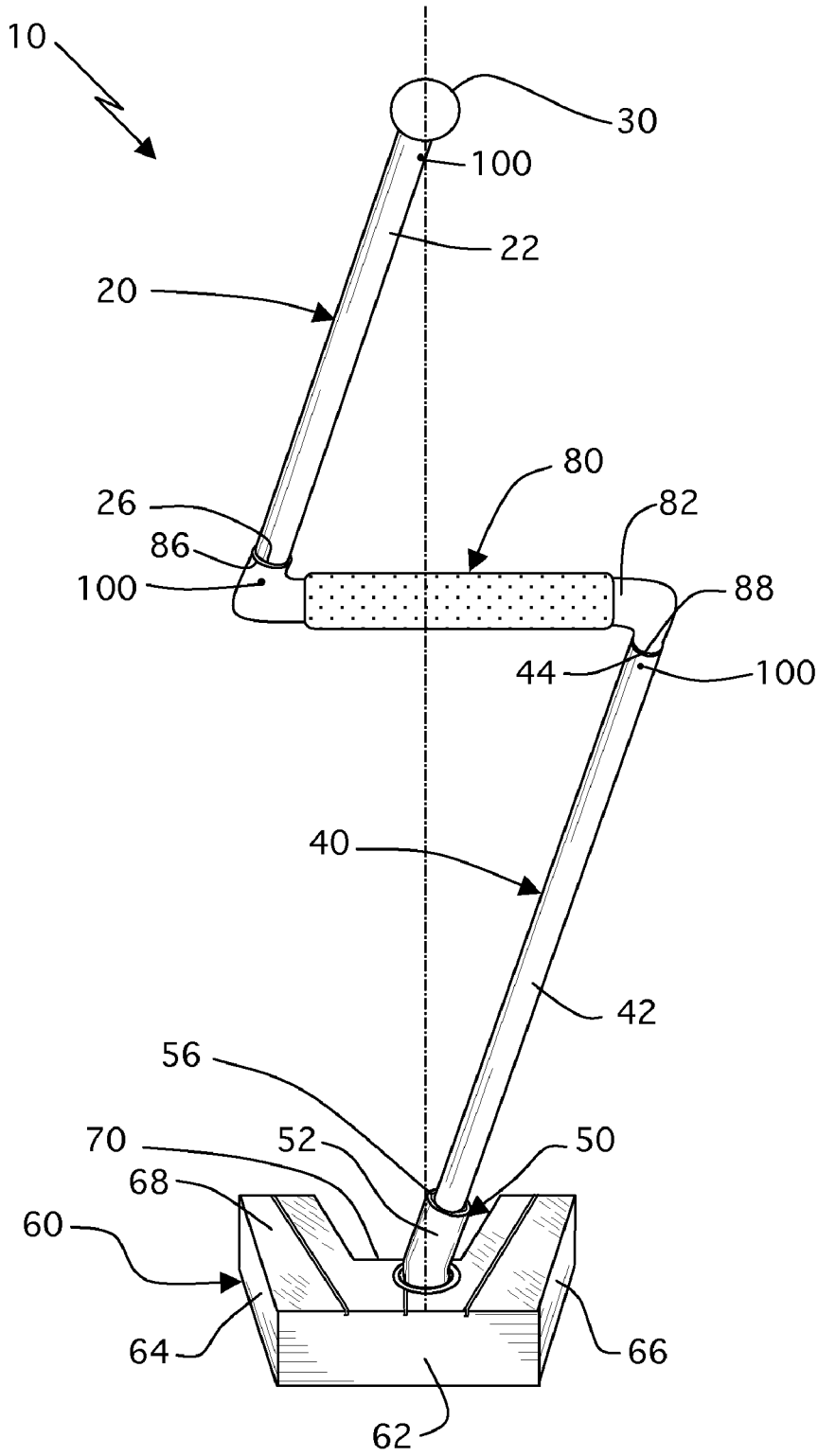
FIG. 3 illustrates an isometric view of the instant invention in a zigzag shape when the handle assembly is installed.

As seen in FIG. 2, handle assembly 80 comprises grip member 82 with ends 86 and 88. Gripping surface 84 covers a portion of grip member 82. Male fitting 90 is disposed at end 88 and it has aperture 92. Male fitting 90 is removable received by female fitting 48 of bottom shaft assembly 40. Female fitting 94 is disposed at end 86. Female fitting 94 removably receives male fitting 28 of top shaft assembly 20. It is noted that ends 86 and 88 are oriented in the same angle as angled portion 52 of hosel assembly 50, as seen in FIG. 3. In this way, when adjustable golf putter 10 is assembled, top shaft member 22 and bottom shaft member 42 are in a substantially parallel disposition with respect to each other.

Figure 2A:
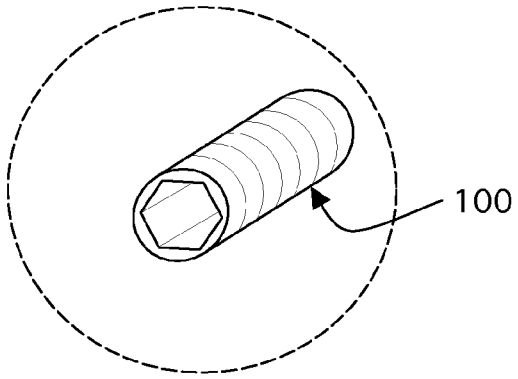
FIG. 2A is an enlarged isometric view of a headless screw as seen in FIG. 2.

Headless screw 100 is best seen in FIG. 2A. Headless screws 100 are screwed into holes 102, and aperture 34 of male fitting 32 once within female fitting 27, aperture 29 of male fitting 28 once within female fitting 94 and aperture 92 of male fitting 90 once within female fitting 48.

Normally, putter heads are connected to a shaft in either of two ways:

1. The majority of putter heads have a hole or socket which is sized to receive a 0.370" diameter shaft, which is cemented in place; and 2. Other putter heads are connected to the shaft by an integral hosel or short metal stub (9/32" or 5/16" diameter), which is inserted and cemented inside a 0.370" outside diameter tubular, unitized metal shaft.

Figure 5:
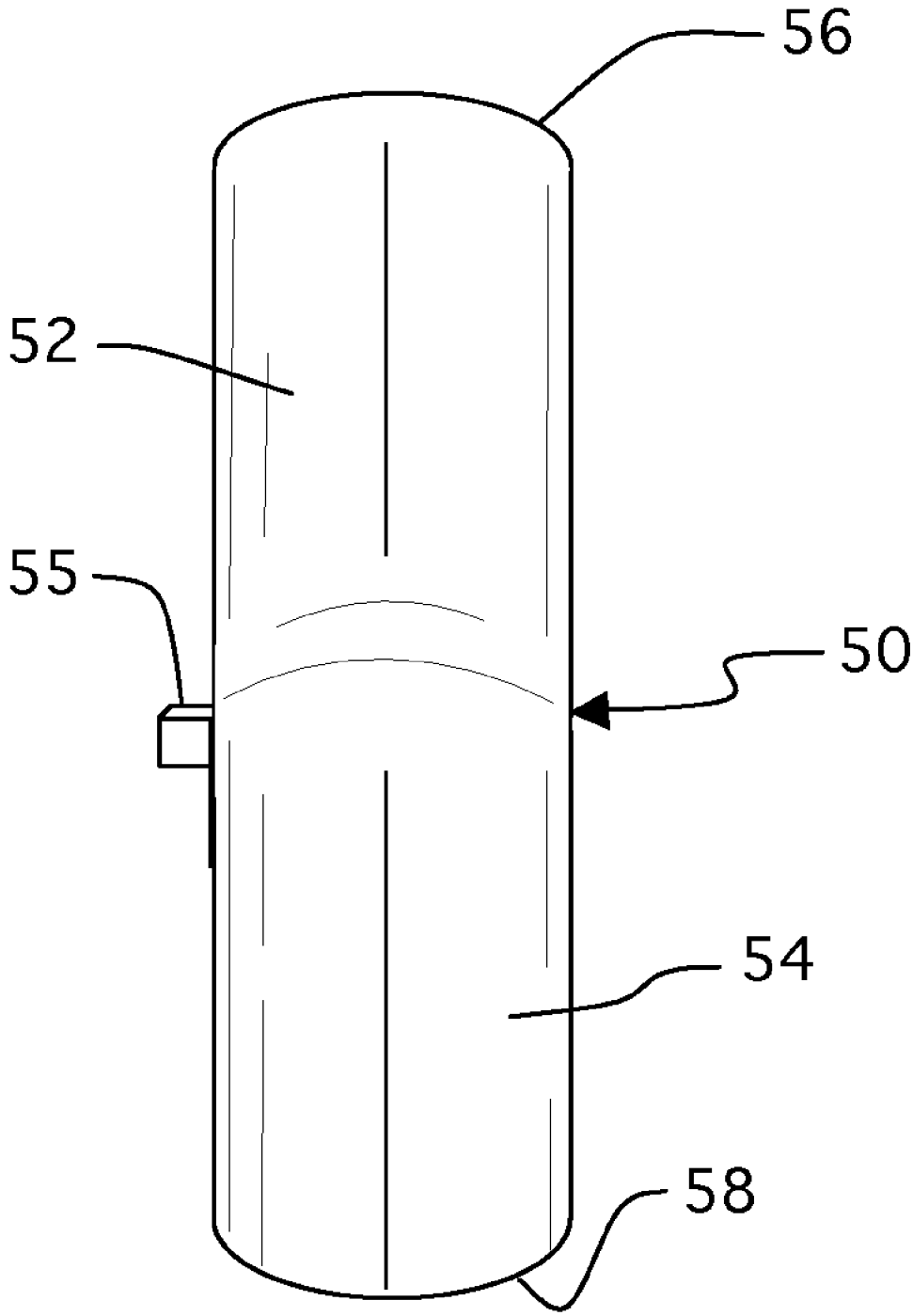
FIG. 5 is an enlarged isometric view of the hosel assembly.

As assembly means for assembling in the zigzag configuration, hosel assembly 50 is inserted into aperture 72 of putter assembly 60. More specifically, protrusion 55, seen in FIG. 5, is aligned with notch 74 and straight portion 54 is snugly inserted into aperture 72. Glue or other adhesive means may be utilized to secure straight portion 54 within aperture 72. End 46 of bottom shaft member 42 is inserted into end 56 of hosel assembly 50. Glue or other adhesive means may be utilized to secure bottom shaft member 42 within end 56. Male fitting 90 is inserted into female fitting 48 until tight. Once tight, hole 102 is aligned with aperture 92. Once aligned, headless screw 100 is screwed into hole 102 and aperture 92. Male fitting 28 is inserted into female fitting 94 until tight. Once tight, hole 102 is aligned with aperture 29. Once aligned, headless screw 100 is screwed into hole 102 and aperture 29. Male fitting 32 is inserted into female fitting 27 until tight. Once tight, hole 102 is aligned with aperture 34. Once aligned, headless screw 100 is screwed into hole 102 and aperture 34. Once assembled, the instant invention takes the zigzag shape as illustrated in FIG. 3.

It is noted that in the preferred embodiment, handle assembly 80 is substantially parallel to the plane of putter head 60 as seen in this illustration. The configuration of the preferred embodiment minimizes stress on the golfer's hands and wrists while one hand is positioned on handle 30 and the other hand is positioned on handle assembly 80, to effectively control the stroke of the instant invention without changing its lie angle. Furthermore, when handle assembly 80 is installed, the instant invention, defining an ergonometric golf putter, has the zigzag shape. This configuration better enables the golfer to sight the ball and effect a putt.

Figure 4:
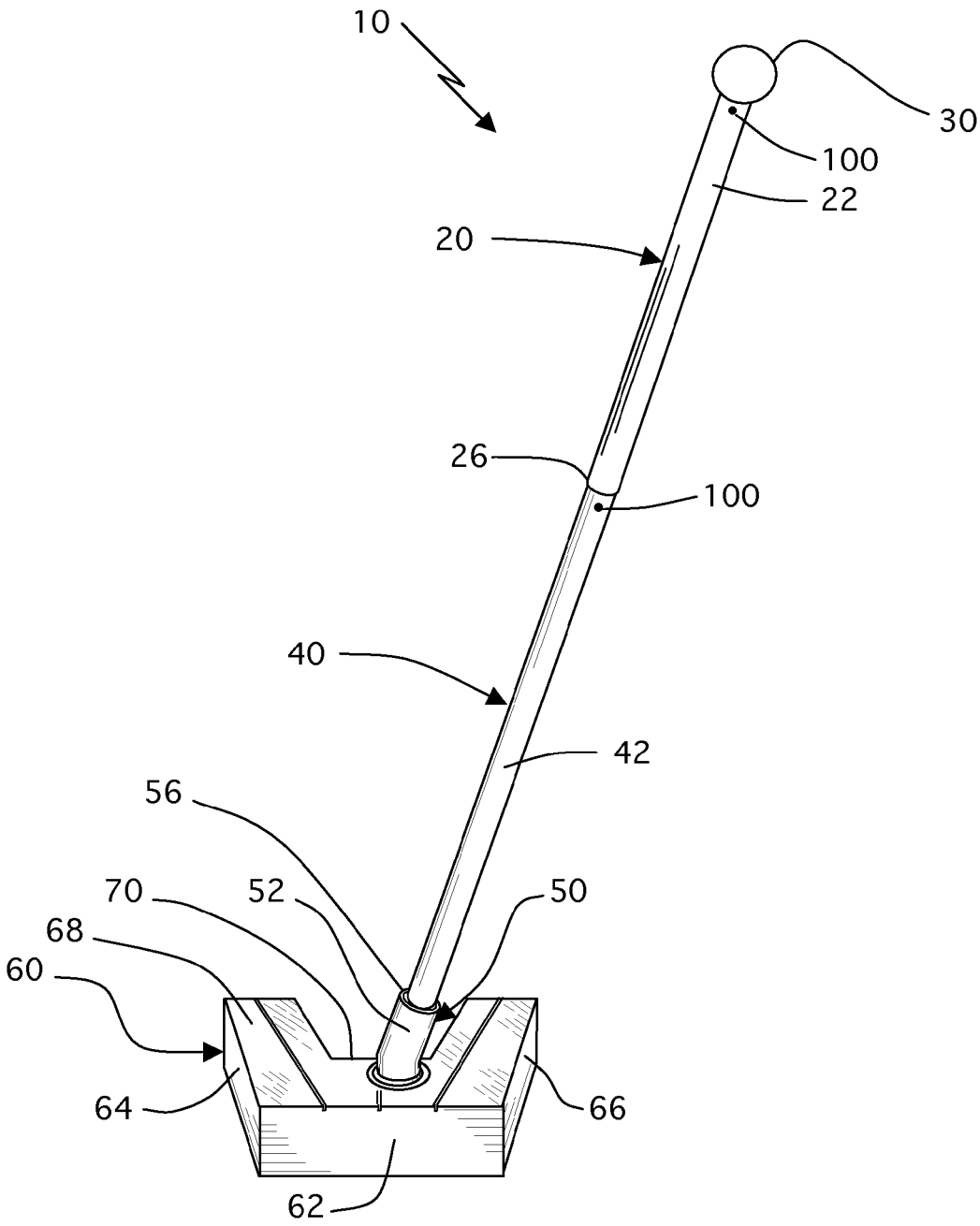
FIG. 4 illustrates an isometric view of the instant invention in a straight shape when the handle assembly is removed.

As seen in FIG. 4, when handle assembly 80 is removed, the ergonometric golf putter has a straight shape. This configuration enables the golfer to utilize the instant invention as a traditional straight golf putter. As assembly means for assembling in the straight configuration, hosel assembly is inserted into aperture 72 of putter assembly 60. More specifically, protrusion 55, seen in FIG. 5, is aligned with notch 74 and straight portion 54 is snugly inserted into aperture 72. Glue or other adhesive means may be utilized to secure straight portion 54 within aperture 72. End 46 of bottom shaft member 42 is inserted into end 56 of hosel assembly 50. Glue or other adhesive means may be utilized to secure bottom shaft member 42 within end 56. Male fitting 28 is inserted into female fitting 48 until tight. Once tight, hole 102 is aligned with aperture 92. Once aligned, headless screw 100 is screwed into hole 102 and aperture 92. Male fitting 32 is inserted into female fitting 27 until tight. Once tight, hole 102 is aligned with aperture 34. Once aligned, headless screw 100 is screwed into hole 102 and aperture 34. It is noted that although handle assembly 80 is not utilized, the lie angle defined by hosel assembly 50 is kept.

Adjustable golf putter 10 allows a golfer to utilize the dimensions of top shaft assembly 20 and bottom shaft assembly 40 according to his/her sizes and preferences, as well as the angle of inclination that best suits his or her stance.

As best seen in FIG. 5, hosel assembly 50 also has protrusion 55 that is positioned on straight portion 54 and abutting angled portion 52. Protrusion 55 snugly fills in notch 74 of putter head 60. Although not illustrated, instant invention 10 allows a golfer to acquire a single top shaft member 20, a single bottom shaft member 40, a single putter head 60, a single handle assembly 80, and a plurality of hosel assemblies of various angles. The golfer then determines the angle of inclination that best suits his or her stance to form a customized putter for that individual to establish a preferred lie angle that is typically in the range from 60 degree to 80 degree from the plane of the putter head 60 to bottom shaft member 40, wherein alternate embodiments of hosel assembly 50 offer a 1 degree to 2 degree lie angle change establishing a preferred lie angle range of said 60 degree to said 80 degree. The golfer selects and installs the hosel that is best suited for his or her preferred lie angle.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An adjustable golf putter comprising:

A) a top shaft assembly having first and second ends;

B) a bottom shaft assembly having third and fourth ends;

C) a plurality of replaceable hosel assemblies each comprising first and second elongated engagement elements and each having a different predetermined angle between their respective first and second elongated engagement elements, each of said different predetermined angle establishing a 1 degree lie angle change between them and within a lie angle range of 60 degree to 80 degree, furthermore each plurality of replaceable hosels having a proximal end and a distal end and each proximal end and a distal end has a longitudinal axis, said first elongated engagement element being substantially hollow to removably receive said third end, and said second elongated engagement element being solid, said second elongated engagement comprising a protrusion located at a first predetermined distance from said distal end and adjacent to said first elongated engagement;

D) a putter head comprising a face and a base plate, said face being substantially perpendicularly disposed with respect to said base plate, said face designed to strike a golf ball when putting, angularly extending from said face are first and second sidewalls, said putter head further comprises a V-shaped top wall that connects said face to said first and second sidewalls, said V-shaped top wall having a merging point that comprises a first aperture, said first aperture having a channel extending towards said base plate a second predetermined distance and not reaching said base plate, said first aperture removably receives said second elongated engagement element and said channel receives said protrusion; and E) assembly means to assemble said top shaft assembly to said bottom shaft assembly to one of said plurality of replaceable hosel assemblies to said putter head.

2. The adjustable golf putter set forth in claim 1, further characterized in that said assembly means comprises one of said plurality of replaceable hosel assemblies directly engaging to said putter head.

3. The adjustable golf putter set forth in claim 2, further characterized in that said assembly means comprises said bottom shaft assembly directly engaging to said one of said plurality of replaceable hosel assemblies.

4. The adjustable golf putter set forth in claim 3, further comprising a removable handle assembly positioned in between said top shaft assembly and said bottom shaft assembly, said top shaft assembly and said bottom shaft assembly extending on a plane substantially parallel to each other, said removable handle assembly aligned extending parallel over said putter head.

5. The adjustable golf putter set forth in claim 4, further characterized in that said first end comprises a first female fitting and said second end comprises a first male fitting having a second aperture, said top shaft assembly further comprising a first hole a third predetermined distance from said first end without reaching said second end.

6. The adjustable golf putter set forth in claim 5, further characterized in that said fourth end comprises a second female fitting, said bottom shaft assembly further comprising a second hole a fourth predetermined distance from said third end without reaching said fourth end.

7. The adjustable golf putter set forth in claim 6, further characterized in that said handle assembly comprises a grip member with fifth and sixth ends, said grip member having a gripping surface positioned in between said fifth and sixth ends, said fifth end comprises a third female fitting and said sixth end comprises a second male fitting having a third aperture, said handle assembly further comprising a third hole a fifth predetermined distance from said fifth end without reaching said sixth end.

8. The adjustable golf putter set forth in claim 7,further comprising headless screws that screw into said first, second and third holes for securing said top shaft assembly to said handle assembly to said bottom shaft assembly.

9. The adjustable golf putter set forth in claim 8, further characterized in that said V-shaped top wall is substantially planer.

10. The adjustable golf putter set forth in claim 9, further characterized in that said face and said first and second sidewalls are a same height.

11. The adjustable golf putter set forth in claim 10, further characterized in that said V-shaped top wall and said base plate are substantially parallel with respect to each other.

* * * * *